United States Patent [19]

Delessard et al.

[11] 4,382,777

[45] May 10, 1983

[54] PROCESS FOR MODIFYING THE PROPERTIES OF A SWELLING COAL, AN INSTALLATION FOR CARRYING OUT THE PROCESS AND A CHAMBER FOR TREATMENT OF COAL BY FLUIDIZATION AND CRUSHING

[75] Inventors: Serge L. J. E. Delessard, Forbach; Roger M. Puff, Freyming Merlebach; Jean-Claude Kita, Forbach, all of France

[73] Assignee: Charbonnages de France, Paris, France

[21] Appl. No.: 250,715

[22] Filed: Apr. 3, 1981

[30] Foreign Application Priority Data

Apr. 4, 1980 [FR] France ..... 80 07726

[51] Int. Cl.[3] ..... F27B 15/00; B02C 1/00

[52] U.S. Cl. ..... 432/15; 241/17

[58] Field of Search ..... 432/14, 15, 58; 241/17

[56] References Cited

U.S. PATENT DOCUMENTS

| | | | |
|---|---|---|---|
| 1,611,791 | 12/1926 | Stockton | 241/17 |
| 1,954,350 | 4/1934 | Dornbrook et al. | 202/108 |
| 2,763,478 | 9/1956 | Parry | 432/15 |
| 3,512,723 | 5/1970 | Geoffroy | 241/34 |
| 3,515,381 | 6/1970 | Foch | 432/15 |
| 4,174,947 | 11/1979 | Delessard et al. | 432/15 |

FOREIGN PATENT DOCUMENTS

| | | |
|---|---|---|
| 1332711 | 6/1963 | France . |
| 1555546 | 1/1969 | France . |
| 2378081 | 8/1978 | France . |
| 641422 | 8/1950 | United Kingdom . |

*Primary Examiner*—John J. Camby

*Attorney, Agent, or Firm*—Cushman, Darby & Cushman

[57] ABSTRACT

The present invention relates to a process for modifying the properties of a swelling coal, to an installation for carrying out the process and to a chamber for treatment by fluidization and crushing. A percussion-type crusher is installed in a fluidization chamber at about 1 meter above the zone of connection between a duct for conveying coal by pneumatic transport and the chamber. A combustion chamber produces gases for transport and fluidization, having an oxygen content of at least 10%.

6 Claims, 1 Drawing Figure

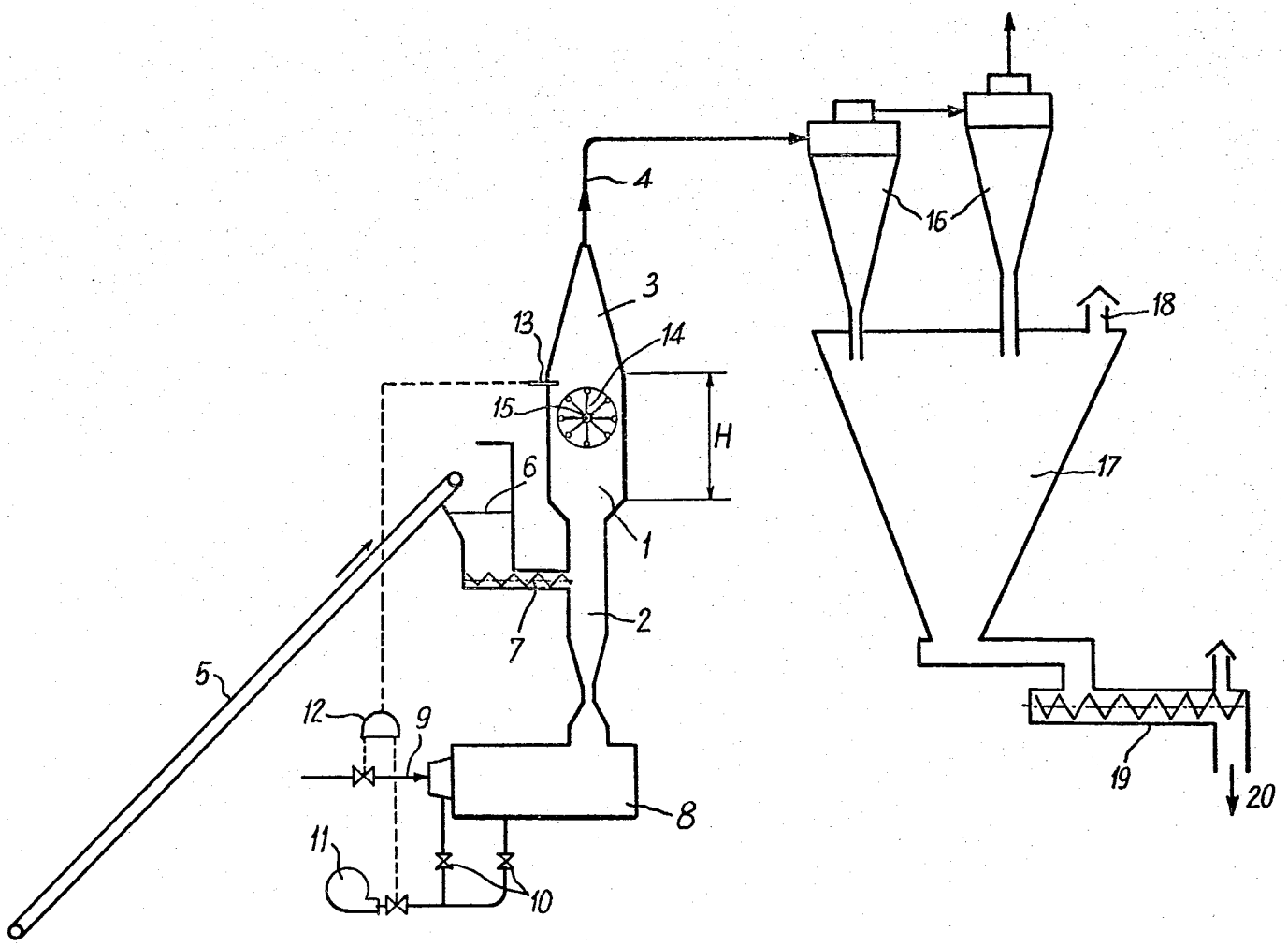
1
2
3
4
5
6
7
8
9
10
11
12
13
14
15
16
17
18
19
20
H

PROCESS FOR MODIFYING THE PROPERTIES OF A SWELLING COAL, AN INSTALLATION FOR CARRYING OUT THE PROCESS AND A CHAMBER FOR TREATMENT OF COAL BY FLUIDIZATION AND CRUSHING

BACKGROUND OF THE INVENTION

The present invention relates to a process for modifying, by mild oxidation, the swelling properties of a swelling coal with an AFNOR swelling index of between 2.5 and 6, such as a high volatile bituminous coal, as well as to an installation for carrying out the process and to a chamber for treatment by fluidisation and crushing.

The production of semi-coke in a rotating oven or in a fluidised bed from fines involves the use of sparingly swelling coal so as to avoid sticking and agglomeration of the fines. Similarly, for manufacturing moulded coke, it may be desirable to have coal with a low swelling index.

French Pat. No. 1 332 711 already proposes oxidising the fines by fluidisation, with considerable recycling of the finest particles, in a bed of which the temperature is greater than 300° C. and lower than the melting temperature of the coal, by means of a gas containing oxygen, for example by combustion gases at 450° C. containing 18% of oxygen. The fact that the fines of coal are previously crushed in practice obliges the temperature of the combustion gases to be limited to about 450° C. to avoid a loss of volatile matter, too much degradation and a beginning of softening and therefore sticking of the finest particles.

It is an object of the invention to propose a novel process, a novel installation and a novel chamber for modifying the swelling properties of the swelling coal whilst substantially conserving their content of volatile matter, and consequently to allow such coal to be used for manufacturing moulded coke or semi-coke in a rotating oven or in a fluidised bed. It is a further object to avoid the degradation of the treated coal whilst using hotter gases, therefore with faster effect.

SUMMARY

This purpose is attained, according to the invention, by a process in which fines of said coal are subjected, in a fluidisation chamber comprising an upper tapered carrying zone, to a fluidised bed treatment, in which the temperature is regulated to at least 300° C. by means of hot combustion gases having an oxygen content greater than 10%, in that the coal, with a particle size coarser than the desired size of the fines, is introduced into the fluidisation chamber and is subjected in the fluidisation chamber to a crushing treatment.

The drawbacks of the process known by French Pat. No. 1 332 711 have already been shown. The invention overcomes these drawbacks in that, as will be seen hereinafter, operation may be effected up to combustion gas temperatures of about 800° C., to which the fairly coarse-grained coal may be exposed without damage, to crush it in the fluidisation chamber where the particles, now finer due to the crushing in the combustion gases, are subjected to less hot gases, since these gases served to dry and/or heat the coal up to the desired temperature before it is crushed to the final particle size.

According to a feature of the invention, the temperature in the fluidised bed is regulated between 300° and 360° C. and preferably in the vicinity of 340° C. and the fines are subjected to a crushing treatment by percussion in a zone of the chamber between the fluidised bed and the tapered carrying zone.

In an advantageous embodiment, the fines are dried before being introduced into the fluidisation chamber, preferably by introducing them in a current of the hot fluidisation gases at carrying velocity.

According to an advantageous feature, the temperature of the hot combustion gases is regulated to a value greater than 500° C. and preferably between 500° and 800° C. In fact, the process makes it possible to introduce the moist coal into the installation in the form of grains of the order of 1 to a few millimeters diameter, which may withstand without damage contact with gases at high temperature. This results in a considerable increase in the production capacity of the installation.

According to a particular embodiment, the treated fines are conducted to a storage container and an oxygen-poor atmosphere is established in this container, and, to obtain an oxygen-poor atmosphere, part of the gases having carried the treated fines is introduced in said storage container.

The purpose of the invention is also attained by an installation comprising:

a chamber for treatment by fluidisation, at the base of which opens a duct for a gaseous fluidisation and carrying agent, and provided with a crusher of percussion type, means for introducing coal fines to be treated in said chamber and/or said duct, a duct for carrying the treated fines by the gaseous agent, connected to the top part of the chamber for treatment by fluidisation, a combustion chamber for producing the gaseous fluidisation and carrying agent directed towards the duct opening in the chamber for treatment by fluidisation, said combustion chamber comprising at least one burner, means for regulating a liquid or gaseous fuel conveyed to the burner, controlled by temperature measuring means in said chamber and means for regulating the rate for combustion air, in that the percussion-type crusher is disposed in an intermediate zone of the treatment chamber and its lowest point is at least 1 meter above the zone of connection between the duct for drying the fines to be treated and the treatment chamber, and the means for regulating the rate of combustion air ensure an excess of air.

An installation of this type therefore presents modifications, appropriate for carrying out the process, with respect to installations for drying and preheating the coal in which the previously crushed moist coal is brought into contact with hot neutral gases, then the coal and the gases are introduced into a fluidisation chamber, at the base of which rotates a crusher. Such installations are for example described in Applicant's French Pat. No. 1 555 546.

For an installation comprising a container for storing treated fines, this container is advantageously swept by part of the fluidisation and carrying gases having carried the treated fines out of the chamber and having transported them into said storage container.

The invention also relates to a chamber for treatment by fluidisation and crushing at the base of which opens a duct for a gaseous fluidisation and carrying agent, and provided with a percussion-type crusher, comprising means for introducing into said chamber and/or said duct, granular and/or pulverulent materials and comprising a duct for carrying the treated materials by the gaseous agent, connected to the top part of the chamber for treatment by fluidisation and crushing, in which the percussion-type crusher is disposed in an intermediate zone in the treatment chamber, and its lowest point is at least 1 meter above the zone of connection between the duct for drying the fines to be treated and the treatment chamber.

Thus, the installation, and particularly, the treatment chamber used for carrying out the invention, differ essentially from those used for drying and preheating the coal according to the teaching of French Pat. No. 1 555 546, in that the crusher is not placed at the base of the fluidised zone, but in the upper or median part thereof, this having for its effect to increase the dwell time of the coal within the fluidised bed.

BRIEF DESCRIPTION OF THE DRAWINGS

The invention will be more readily understood on reading the following description with reference to the accompanying drawings, in which:

the single FIGURE schematically shows an installation according to the invention with a chamber for treatment by fluidisation according to the invention, for carrying out the process of the invention.

DESCRIPTION OF A PREFERRED EMBODIMENT

Referring now to the drawing, the installation shown therein comprises a chamber 1 for treatment by fluidisation, comprising a constant rectangular cross section over a height H progressively connected at its base to a duct 2 for a gaseous fluidisation agent and, by a tapering connecting zone 3, to increase speed, to a duct 4 for carrying the treated fines. Coal in the state of fines is conveyed by a conveyor 5 onto a screen 6 where the screen undersize is taken up by a screw loading device 7 for introducing the coal fines in the duct 2. To create a rising movement of the gaseous fluidisation and carrying agent, a combustion chamber 8 is provided, supplied with gas and air via conduits 9 and 10 respectively, the air being pulsated by a fan 11. A regulating device 12 controls the rates of flow of gas and air by a reference temperature measured by a thermometer 13 placed in the chamber 1 and regulates the proportion of gas and air with an excess of air such that the combustion gases produced in the combustion chamber 8 have an oxygen content higher than 10%.

The height H of the constant section of the parallelepipedic part of the chamber 1 is 3 meters. This part of the chamber, of which the transverse section is 0.56 m×0.18 m, comprises a rotating crushing device 14 with horizontal shaft 15 of the percussion crusher type, such as a rod mill or a hammer mill, with a diameter of 0.4 m, but, contrary to the conventional arrangement, the shaft of this crusher 14 is at such a height that there is about 1 m between its lowest point and the lower part of the parallelepipedic part of the chamber. According to Applicant's observation, the crusher disposed according to the invention performs a role of dispersion and/or of regulation more than of crushing, the coal which is introduced already being fine. The crusher being in a higher position than is usual, the fluidised bed is more dense and the dwell time is therefore longer, this being favourable to a more thorough treatment.

The duct 4 for carrying the oxidised coal opens into a set of cyclones 16, at the vortex of which the gases are evacuated and at the underflow pipe of which the oxidised coal is directly collected in a hopper 17, which is tight except for a gas extraction vent pipe 18 and at the base of which is disposed a moistener take-up worm 19 leading to a user 20. It will be seen that the gases which are oxidising but which have lost part of their oxidising power, serving as pneumatic transport fluid, the atmosphere in the hopper is constituted by these gases which are then relatively poor in oxygen, and in any case poorer than the air. The hopper 17 may be mounted on balances for any possible use such as initiating the emptying of the load towards the user 20 or stopping supply by the screw 7.

The installation is in fact regulated as follows:

the operator selects a rate of flow of coal, the rate of air at the burner is maintained constant, the temperature in the reaction zone is maintained constant by acting on the rate of flow of gas. If the temperature of the bed drops (humidity of the coal increasing, for example), the rate of flow of gas is increased, the temperature of the combustion gases then increases, whilst the excess of air reduces, this bringing about a rise in the temperature in the reaction zone. If, on the contrary, the temperature rises, the rate of flow of gas must be reduced and the temperature of the combustion gases will diminish. However, the excess of air increasing, the reaction may become violent. An injection of water should therefore be provided in the reaction zone, as a safety precaution, as is known per se.

EXAMPLE

The installation described has been used for treating a high volatile bituminous coal, having the following properties:

Swelling index 5 according to AFNOR standard NF M 11 001 of November 1968.

Content of volatile matter on a dry basis: 37%.

Ash content: 5%

Humidity: 6.1%

Particle size: 98%<5 mm, 86.4%<3.15 mm, 71.1%<2 mm, 22.2%<0.5 mm.

Coarser products would risk producing clogging.

The operating conditions of the installation were as follows:

Rate of flow of coal: 700 kg/hr. (dry matter) or about 7000 kg/hr per $m^2$ of section of the treatment zone.

Temperature of the gases on leaving the combustion chamber: 780° C.

Oxygen content of the gases on leaving the combustion chamber: 15%

Temperature of treatment (crushing and oxidation zone): 340° C.

Speed of the gases (crushing and oxidation zone): 43.5 m/s

Pressure drop (crushing and oxidation zone): 425 mm CE.

The oxidised coal obtained under these conditions had the following characteristics:

Swelling index: 1 to 1.5 according to AFNOR standard

Volatile matter: 33.5 to 35.5%

Humidity (after moistener worm): 9%

Ash content: 4.9%

Particle size: 91 to 96%<2 mm; 38 to 46%<0.5 mm

It will be seen that the invention has enabled the swelling index to be substantially reduced, without notable reduction in the content of volatile matter, and that the coal thus treated may serve as raw material for making a semi-coke, which was impossible with the starting coal. Without passing through a moistener worm, the oxidised coal may even be used directly to be coked immediately in a rotating oven or in a fluidiser.

We claim:

1. Process for modifying by mild oxidation, the swelling properties of a swelling coal, in a chamber containing a fluidized bed supplied at its base with combustion gases having an oxygen content greater than 10% and with fines of coal to be treated, said chamber having at its top part a duct for removal of the treated fines and having crushing means located within the chamber comprising the steps of, (a) introducing the fines to be treated into the chamber, said fines having a greater particle size than the treated fines, (b) crushing said fines in said fluidized bed wherein the temperature of the combustion gases is regulated to a value of between 500° C. and 800° C., and the temperature within the fluidized bed is regulated between 300° C. and 360° C.

2. Process in accordance with claim 1 wherein said crushing occurs in the upper or median portion of the fluidized bed.

3. Process in accordance with claim 1 wherein said fines to be treated are subjected to a drying step before the fluidized bed.

4. Process in accordance with claim 3 wherein the fines are dried by feeding said fines into the combustion gases at the carrying velocity before being introduced into said chamber.

5. Process in accordance with claim 1 wherein said treated fines are conducted to a storage container wherein an oxygen-poor atmosphere is maintained.

6. Process in accordance with claim 5 wherein said oxygen-poor atmosphere is maintained by introducing into said storage container at least a portion of said combustion gases carrying said treated fines.

* * * * *